US005165629A

United States Patent [19]

Breveglieri

[11] Patent Number: 5,165,629

[45] Date of Patent: Nov. 24, 1992

[54] ADJUSTABLE TOOL HOLDER ASSEMBLY

[75] Inventor: Frank L. Breveglieri, Spring Lake, Mich.

[73] Assignee: Geerpres, Inc., Muskegon, Mich.

[21] Appl. No.: 727,880

[22] Filed: Jul. 10, 1991

[51] Int. Cl.[5] ..... A47F 7/00

[52] U.S. Cl. ..... 248/110; 211/60.1; 211/70.6; 211/89; 248/113; 248/316.3

[58] Field of Search ..... 248/316.3, 110, 113, 248/287, 231.6; 211/65, 70.6, 89; 403/104, 106, 107, 108

[56] References Cited

U.S. PATENT DOCUMENTS

| | | | |
|---|---|---|---|
| 893,347 | 7/1908 | Morell | 248/113 |
| 1,081,381 | 12/1913 | Hakes | 248/113 |
| 1,366,324 | 1/1921 | Newquist | 248/113 |
| 1,414,541 | 5/1922 | Arey et al. | 248/316.3 |
| 1,481,981 | 1/1924 | Boye | 403/109 X |
| 2,214,388 | 9/1940 | Summers | 403/108 |
| 2,370,876 | 3/1945 | Richardson | 248/316.3 X |
| 3,013,756 | 12/1961 | Boston | 248/316.3 X |
| 4,181,293 | 1/1980 | Laribee | 403/108 X |
| 4,359,163 | 11/1982 | Ratti | 211/70.6 |
| 4,852,747 | 1/1989 | Breveglieri | 211/70.6 |

FOREIGN PATENT DOCUMENTS

| | | | |
|---|---|---|---|
| 1126569 | 11/1956 | France | 248/316.3 |

*Primary Examiner*—Alvin C. Chin-Shue
*Assistant Examiner*—Derek J. Berger
*Attorney, Agent, or Firm*—Harness, Dickey & Pierce

[57] ABSTRACT

An adjustable holding device whereby different handled objects such as tools brooms and the like may be vertically hung. The holding device is adjustable and can retain handled objects of various widths. The adjustable holding device can either be directly mounted to a wall or can be retained in an elongated support bracket. The elongated support bracket can retain several adjustable holding devices, which allow several different handled objects to be hung vertically in side-by-side relation.

21 Claims, 3 Drawing Sheets

FIG. 1.
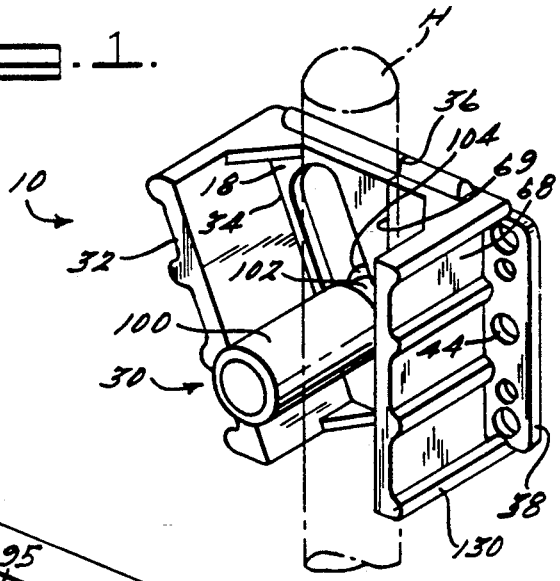
FIG. 2.
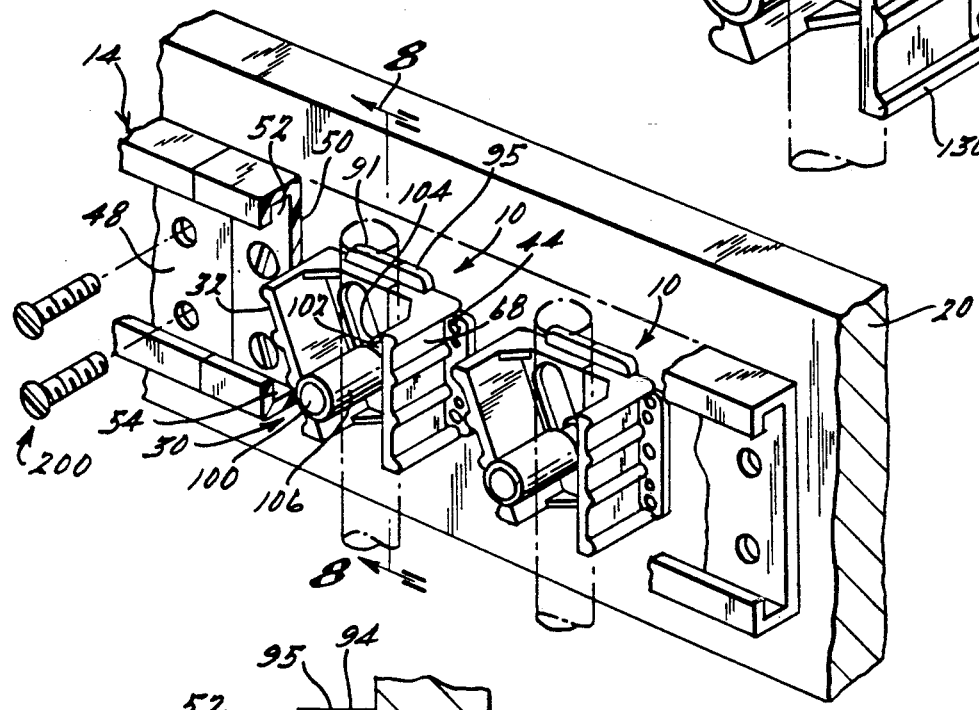
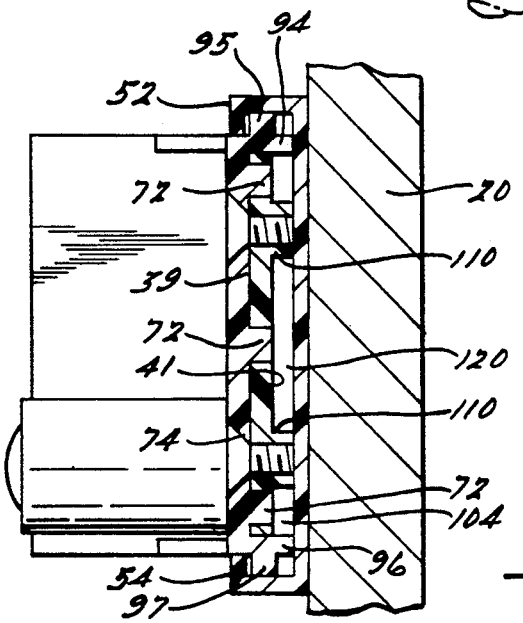
FIG. 8.

FIG. 6.
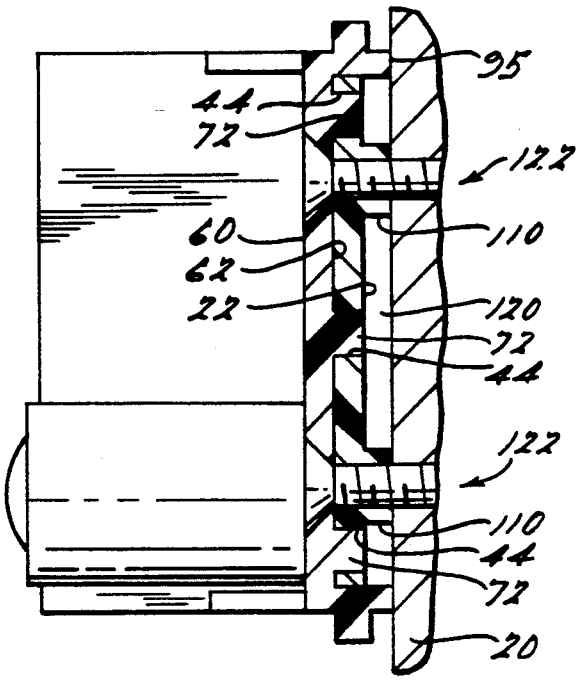
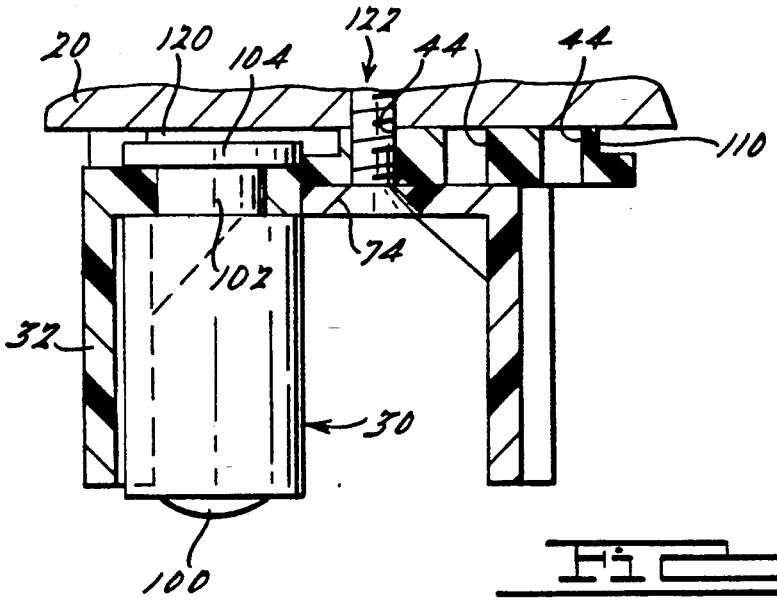
FIG. 7.

ADJUSTABLE TOOL HOLDER ASSEMBLY

BACKGROUND AND SUMMARY OF THE INVENTION

This invention relates to a gravity operated quick release adjustable holding device for handled objects, whereby handled objects such as brooms, mops, tools and the like may be vertically supported on a wall.

The primary object of this invention is to provide an adjustable holding device for use with handled objects. The holding device can be adjusted so that handled objects of different widths or thicknesses can be retained in the holding device. A fastener may be used to directly secure the adjustable holding device to a wall.

Another object is to retain the adjustable holding device herein in the support bracket shown in commonly owned U.S. Pat. No. 4,852,747. The support bracket can be used to retain both the adjustable holding device herein as well as unitary holding device. The support bracket is extruded of a suitable polymeric material and configured both to interconnect with other like brackets to form a continuous support surface as needed and to interengage with the adjustable holding device to allow the device to be moved relative to the bracket. Several adjustable holding devices can be retained in the support bracket. When the adjustable holding devices are engaged in the support bracket, a fastener can be used to secure the support bracket and adjustable holding device directly to a wall.

The foregoing and other objects and attendant advantages will become more apparent when viewed in light of the accompanying drawings and following detailed description wherein:

BRIEF DESCRIPTION OF THE DRAWINGS

FIG. 1 is a perspective view of an adjustable holding device in accordance with this invention in gripping relation with a tool handle, shown in phantom;

FIG. 2 is a perspective view of a mounting arrangement for selectively positioning and holding handled objects in side-by-side relation including a support bracket retaining several adjustable holding devices according to FIG. 1;

FIG. 6 is a cross-sectional elevation view of the adjustable holding device taken along the line 6—6 of FIG. 5;

FIG. 7 is a cross-sectional top plan view of the adjustable holding device taken along line 7—7 of FIG. 5; and FIG. 8 is a cross-sectional elevation view of the support bracket and adjustable holding device taken along line 8—8 of FIG. 2.

DETAILED DESCRIPTION OF THE PREFERRED EMBODIMENT

Turning now to the drawings in accordance with this invention, FIGS. 1–8 show an adjustable device 10 for quickly releasably holding the elongated handles of brooms, mops, tools and like objects on a wall 20 and in a vertical upright position. The adjustable holding device is adapted to permit an elongated handle H to be quickly and easily inserted and removed therefrom for use. The holding device is laterally adjustable, in either of two ways, and thus permits the holding retention of a variety of handle thicknesses.

Figure 3:
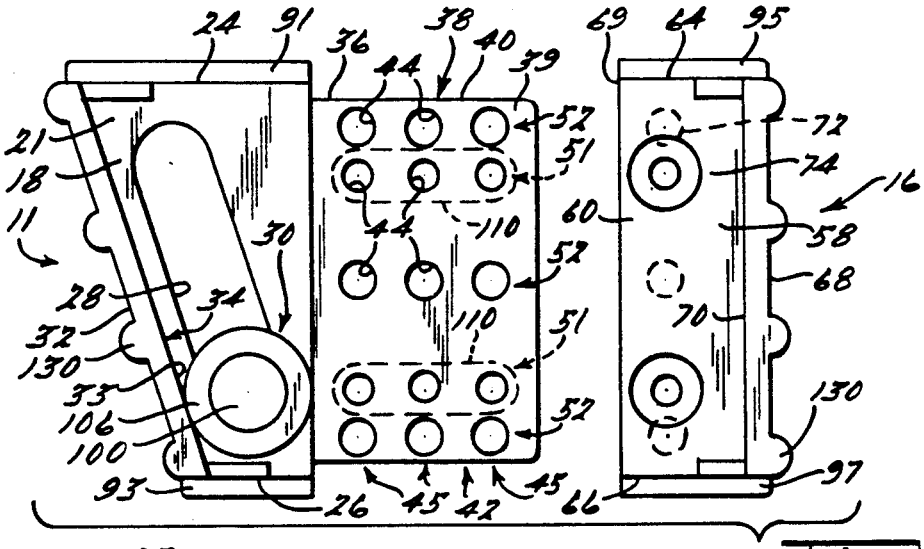
FIG. 3 is a front elevation view of first and second members of the adjustable holding device.

In accordance with the invention, the adjustable holding device 10 is formed of a polymeric material and, as illustrated in FIG. 1, comprises a first member 11 and second member 16. As illustrated in FIG. 3, the members are connectable together into a generally U-shaped frame and disconnectable, as desired, to change the lateral separation between sidewalls 32 and 68 thereof. The first member 11 comprises a flat base 18 having top and bottom surfaces 21 and 22, upper and lower surfaces 24 and 26 and an inclined slot 28 extending between the top and bottom surfaces, a cylindrical shaft 30 rollably journalled for rotation and vertical movement in the slot, and a generally flat wall member 32 upstanding generally perpendicularly from a lateral edge 34 of the first member base. Extending from the opposite lateral edge 36 of the first member base 18 is an elongated flange 38 having top and bottom surfaces 39 and 41, and upper and lower surfaces 40 and 42. The second member 16 comprises a base 58 with planar top and bottom surfaces 60 and 62, upper and lower surfaces 64 and 66, opposite lateral edges 69 and 70, and a generally flat wall member 68 upstanding generally perpendicularly from the lateral edge 70 of the base 58. The wall member 32 of the first member 11 and the wall member 68 of the second member 16, respectively, are on opposite lateral edges 34 and 70 of their respective bases 18 and 58.

As illustrated in FIG. 1, the lateral edges 36 and 69 are abutted when the members 11 and 16 are connected together and at their closest inward positions.

Preferably and in accordance with this invention, an arrangement is provided whereby the first and second members 11 and 16 may be connected together and disconnected, as desired, whereupon the lateral spacing between the wall members 32 and 68 can be increased or decreased. In the embodiment shown, a plurality of locking projections or posts 72 are adapted to interlock with respective apertures 44 of a predetermined generally rectangular grid (or array) of like apertures. The apertures 44 extend between the top and bottom surfaces 39 and 41 of the elongated flange 38 and the posts 72 are integrally formed with and project from the bottom surface 62 of the base 58.

In the preferred embodiment shown, the grid arranges the centers of a plurality of apertures at the intersection of parallel intersecting vertical and horizontal lines. The grid includes three parallel vertical lines that intersect five parallel horizontal lines. The grid comprises three laterally spaced vertical rows shown at 45, each row comprised of three spaced apertures 44 disposed on respective vertical lines; three horizontal rows shown at 52 each comprised of three apertures 44; and two horizontal rows shown at 51 each comprised of three apertures.

Three posts 72 are suitably vertically spaced on a vertical line and adapted to register with and interlock within a corresponding aperture 44 when the post row is positioned with one of the three aperture rows 45. The posts have their centers aligned with the horizontal rows 52 and are sized for interlocking receipt within the corresponding apertures in each successive vertical row 45 as the members 11 and 16 are moved laterally relative to one another. Each of the apertures 44 and associated posts 72, while shown as being circular in shape, could be differently shaped.

Further, and in accordance with this invention, the flange 38 is provided with a pair of apertures 74 which pass between the top and bottom surfaces 39 and 41 thereof. The apertures 74 are disposed between the upper and lower surfaces 40 and 42 and have their centers on the same vertical line as that of the projections 72 and aligned with the horizontal aperture rows 51. As shown, the apertures 74 are disposed between a pair of projections 72.

When the row of vertically spaced locking projections 72 is aligned with a selected row 45 of vertically spaced apertures 44, and the respective posts 72 are interlockingly received within a corresponding aperture 44 thereof, the first and second members are connected together and lateral separation therebetween is prevented. The projections 72 can be inserted into the apertures in any of the three laterally separated parallel rows 45 of apertures, thereby defining discrete lateral adjustment positions for the holding device. The connected positions of the members 11 and 16 permits the holding device to hold elongated handled objects, with handles of various widths or thicknesses. When the locking projections 72 of the second member 16 are inserted into one preselected set of apertures 44 on the first member 11, the wall member 32 of the first member and the wall member 68 of the second member define a V-shaped throat, as illustrated in FIG. 1. The projections 72 on the second member 16 are retained in three apertures of one set of apertures 44 on the first member. The remaining apertures in the preselected set of apertures 44 will be aligned with apertures 74 on the second member 16.

Figure 4:
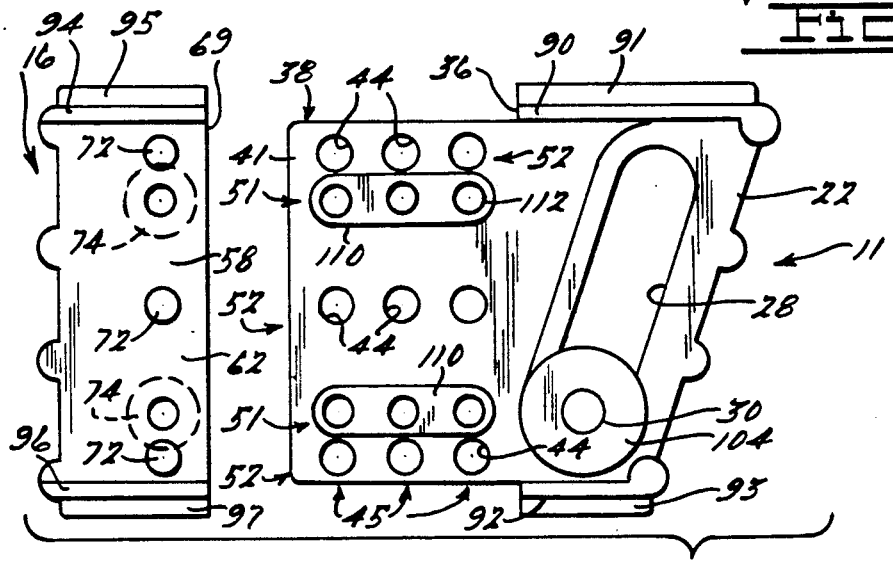
FIG. 4 is a rear view of the first and second members of the adjustable holding device.
Figure 5:
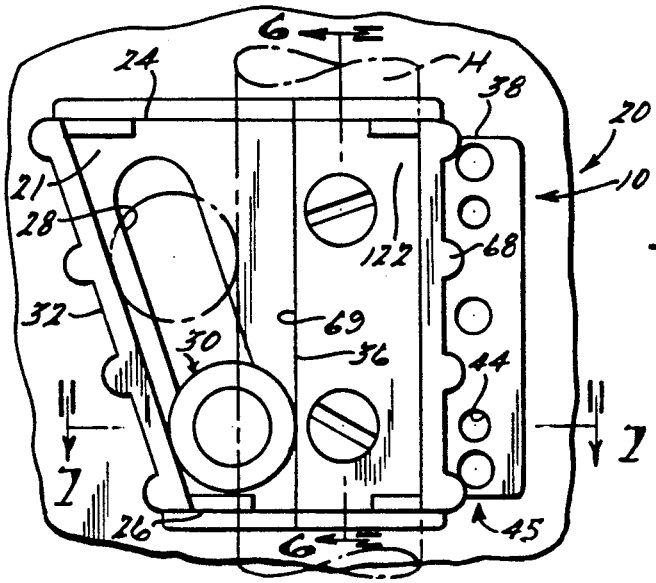
FIG. 5 is a front elevation view of the adjustable holding device when the first and second members are interconnected in their inwardmost position and mounted to a support wall.

Further and in accordance with this invention, as illustrated in FIG. 4, a pair of elongated, horizontally extending, spacer plates 110 project from the bottom surface 41 of the flange 38. The spacer plates are used to mount the holding device to the support wall, as will be described hereinbelow, provide reinforcement, and space the flange 38 from the support wall. The apertures 44 from each horizontal row 51 are arranged horizontally and each extends through its spacer plate 110 to form openings shown at 112. When the members are connected, the apertures 74 are aligned with the apertures having openings 112. As illustrated in FIG. 5, a fastener 122 is inserted through the aligned apertures 74 and 44, respectively, passing through the flange 38 and the spacers 110 of the first member 11, outwardly of the openings 112, and through the second member 16, and secured to the wall 20, thereby allowing the adjustable holding device 10 to be directly mounted onto the wall 20. Further, the fastener will prevent any disconnection between the first and second members 11 and 16 when so mounted.

Advantageously, the plate 110 can be used as a stop member to define a space 120 between the bottom surface 22 of the first member base 18 and the wall 20 on which the adjustable holding device will be mounted. The space 120 advantageously allows the cylindrical head portion 104 of the shaft 30 to rotate and move freely relative to the slot. A fastener 122 such as a flat headed screw or round headed screw can be used to immovably secure the adjustable holding device 10 relative to the wall 20. When the adjustable holding device 10 is mounted to a wall 20, the top 21 and bottom 22 surfaces of the first member 11 and the top 60 and bottom surfaces 62 of the second member 16 are each in a plane generally parallel to the wall. The upper 24 and lower surfaces 26 of the first member 11 and upper 64 and lower 66 surfaces of the second member 16 are each in a plane generally parallel to the floor. The wall member 32 of the first member 11 is in a plane inclined at an acute angle to the floor. Wall member 68 of the second member 16 is in a plane generally perpendicular to the floor. Both wall members 32 and 68 have reinforcing ribs 130 to resist deflection from the U-shape, as illustrated by FIG. 3. The elongated flange 38 of the first member 11 is also generally parallel to the wall. As illustrated in FIG. 1, the roller shaft 30 has its axis generally perpendicular to first member base 18 and includes a first portion 100 disposed adjacent to the inclined wall member 32, a reduced second portion 102 disposed in the slot, and a cylindrical head portion 104 extending rearwardly from surface 22 of the first member base 18 to retain the shaft 30 in the slot 28. As illustrated in FIG. 4, a cylindrical body 106 of a durable elastometer such as rubber encloses first portion 100 of shaft 30 to grippingly engage the handle. The weight of the shaft is such that gravity always pulls the shaft to the bottom of the slot 28.

When the apertures of the first and second members are aligned, wall member 68 of the second member 16 and the shaft 30 define fixed and movable gripping members, as illustrated in FIG. 1. The shaft 30 defining a movable gripping member is supported in the slot 28 for vertical movement toward and away from the fixed gripping member 68 in a direction inclined thereto, so as to produce a gripping force on the handle H of the object placed therebetween. Wall member 32 of the first member 11 has a surface 33, and defines a fixed gripping member in that the rubber annulus 106 bears against the inclined surface during vertical rolling movement to resist lateral forces acting on shaft 30 by the handle H from affecting the connection afforded by the head portion 104 and assures that a good gripping force is transmitted against the handle H in cooperation with the wall member 68 of second member 16.

In use, a handle H would be positioned adjacent the lower surface 26 of the holding device 10 and inserted axially upward between wall members 32 and 68 causing the shaft 30 to be driven upwardly to accommodate the handle width, as illustrated in FIG. 5. The wall members 32 and 68 can be adjusted so that apertures on the first and second members are aligned to accommodate handled objects of different widths and thicknesses. A frictional gripping force resists unwanted downward movement of the handle. When the handled object is needed, the user forces the handle axially upward and outward from the wall members, upward movement also causing upward vertical movement of the roller. Thereafter, the roller falls downwardly in slot 28 and ready for use.

The adjustable holding device can also be incorporated into the support bracket as discussed in U.S. Pat. No. 4,852,747, as illustrated in FIG. 2. The support bracket 14 is extruded of a suitable polymeric material into a square-C cross-section and configured both to interconnect with other like brackets and to form a continuous support surface as needed and to interengage with the adjustable holding device 10 to allow the device to be moved relative to the bracket.

The support bracket 14 has a generally planar top surface 48 against which the spacer plates 110 are abutted, a bottom surface 50 which abuts against the wall 20, and upper and lower channels 52 and 54. The channels 52 and 54 extend horizontally and are generally parallel to one another. Further, the first member 11 includes a pair of spacer ribs 90 and 92 that project from the lower surface 22 and a pair of guide ribs 91 and 93 that extend from the top and bottom surfaces 24 and 26. The second member 16 includes a pair of spacer ribs 94 and 96 that project from the rear surface 62 and a pair of guide ribs 95 and 97 that extend from their respective upper and lower surfaces 64 and 66. Several adjustable holding devices can be retained in the interconnected support brackets.

The plates 110 and the spacer ribs 90, 92, 94 and 96 define a space 120 between the bottom surface 22 of the first member base 18 and the top surface 48 of the bracket 14. The space 120 advantageously allows the cylindrical head portion 104 of the shaft 30 to rotate and move freely relative to the slot 28. The locking projections 72 are integrally formed with the bottom surface 62 of the base member 58 and are cylindrical in shape. The second member base also has at least one, preferably two apertures 74, which extend between the top 60 and bottom 62 surfaces of the second member base 58 and extend vertically from the upper surface 64 to the lower surface 66 of the second member 58. The projections of the second member will be retained in the apertures of the first member, interconnecting the first and second members. The holding device will then be positioned in the support bracket. The holding devices can be moved in the bracket 14 independently of one another. The upper channel 52 is sized to receive guide ribs 91 and 95 of the first and second members, respectively. The lower channel 54 is sized to receive guide ribs 95 and 97 of the first and second members, respectively. The channels 52 and 54 snugly interengage with the edges guide ribs 91, 93, 95 and 97, to retain but allow the adjustable holding device to be selectively positioned at horizontal positions defined by the mounted bracket. When the holding device is positioned in the support bracket, the support bracket can be mounted to a wall by a fastener 200. The first and second members 11 and 16 of the holding device can still be adjusted to accommodate handled objects of different widths. However, when adjusting members 11 and 16 to accommodate handled objects of different widths, the holding device must be removed from the support bracket 14.

While it will be apparent that the preferred embodiment of the invention disclosed is well calculated to provide the advantages and features above stated, it will be appreciated that the invention is susceptible to modification, variation and change without departing from the proper scope or fair meaning of the subjoined claims.

What is claimed is:

1. A device for releasably holding the handle of a tool in vertically disposed relation to a wall, said device comprising: a first member; a second member; first and second guide members extending from each said first and second member; an elongated support bracket adapted to be horizontally mounted on a substantially vertical wall; means for preventing said holding device from being inadvertently removed from said support bracket; gripping means disposed in part on said first member and on said second member for releasably gripping the tool handle; and adjustable connecting means for connecting the first member to the second member and laterally adjusting the position of said first member relative to said second member, said gripping means comprising a movable and a fixed gripping element formed, respectively, on one and the other of said first and second members, and the gripping elements defining a vertically adjustable throat for receiving and producing a gripping force on the handle when placed therebetween, said support bracket having a squared-C cross-section to define a pair of horizontally extending channels, said channels being sized to receive a respective guide member extending from said members for retaining and permitting said holding device to be selectively positioned at any desired horizontal position defined by said support bracket, said first member being disconnected from said second member during said adjustment, and said connecting means including a plurality of locking posts integrally formed on and extending from one of said members for interlocking engagement with a predetermined set of openings in the other of said members.

2. The holding device as claimed in claim 1, further comprising securing means for securing said device to a wall, and spacer means for spacing said gripping means from said wall when said device is secured to said wall, said securing means including a fastener extending through said spacer means for immovably fastening said holding device to said wall.

3. The holding device as recited in claim 1 wherein said support bracket is comprised of a plurality of like-sectioned support brackets having their ends abutted.

4. The holding device as recited in claim 3 wherein a plurality of holding devices are retained by said support bracket to hold a respective plurality of elongated handles in side by side relation.

5. An adjustable multiple object holding device adapted to be mounted to a suport wall, said device characterized by a horizontally extending support bracket, and a plurality of quick release holding devices mounted in laterally spaced apart relation in said support bracket; each said holding device including a first member, a second member connectable to said first member, each said member having a connector plate extending therefrom and upper and lower guide ribs, laterally adjustable interlocking means for interlockingly connecting the connector plates together in a plurality of predetermined lateral spacings, said connector plates being the sole means of connecting the first and second members together, and laterally adjustable gripping means for gripping a handled object, said gripping means including a fixed gripping element associated with said first member and a vertically rollable member associated with said second member, said support bracket including upper and lower horizontally extending channels each sized to receive, respectively, the upper and lower guide ribs extending from said first and second members, spacer means for spacing said first member from said support bracket whereby to define a space therebetween, and stop means for preventing said holding devices from being inadvertently removed from said support bracket, said vertically rollable member comprising a gravity operated roller having opposite end portions, one end portion being journalled for rotation in said space and the other end portion being mounted for vertical lateral movement towards and away from the fixed gripping element whereby to grip a handle object inserted between said wall members.

6. The holding device as recited in claim 5 wherein said edges extending from said upper and lower surfaces of said first member base and second member base, each edge being positioned relative to the bracket by the spacers and sized to fit snugly in a respective channel.

7. A tool holder for releasably holding a tool handle in vertical relation on a support wall, said holder comprising a pair of mounting plates, gripping means disposed in part on each said plate for releasably gripping the tool handle, adjustable connecting means for connecting the plates together and changing the lateral separation between said plates whereby to allow said gripping means to accommodate larger or smaller sized handles, and securing means for securing the mounting plates to said wall, said connecting means comprising a pair of connecting plates extending, respectively, from one and the other of said mounting plates and disposed in overlapped relation, a plurality of post members projecting from one of said connecting plates and linearly arranged in a row disposed vertically, and plurality of first apertures extending through the other of said connecting plates, said apertures being linearly arranged in at least two laterally spaced vertically disposed parallel rows, said apertures forming a rectangular array with the apertures in either of said rows being adapted to interlockingly receive a corresponding post when the row of post members is superposed over a preselected row of said apertures, and said securing means including aligned pairs of second apertures extending through each of said connecting plates, said second apertures being adapted to receive a fastener passed therethrough for fastening said connecting plates to said wall, 8. The holder as claimed in claim 7 wherein said apertures are generally equidistantly spaced.

9. The holder as claimed in claim 7, wherein said posts and said apertures are generally cylindrical in cross-section.

10. The holder as claimed in claim 7 wherein said array comprises, respectively, three vertical rows and three horizontal rows of apertures.

11. The holder as claimed in claim 7, wherein said row of posts comprises three vertically aligned posts and each said row of apertures comprises three vertically aligned apertures spaced to receive a respective post.

12. The holder as claimed in claim 7, further comprising spacer means integrally formed with one said mounting plate for spacing said mounting plates from said wall and forming a space between the wall and the mounting plate, said gripping means being disposed in part in said space, and said second apertures extending through said spacer means.

13. The holder as claimed in claim 7, further comprising spacer means for spacing said mounting plates from said wall and stabilizing said tool holder when secured to said wall, said spacer means comprising first and second plates projecting from said other of said connecting plates.

14. The holder as claimed in claim 7, wherein said gripping means includes a fixed gripping element on one said mounting plate and a vertically movable gripping element on the other said mounting plate, and gripping elements projecting generally perpendicularly from its associated mounting plate.

15. In a multiple tool holding assembly wherein different handled objects may be hung vertically in side-by-side relation, said assembly including an elongated squared-C support channel extending horizontally, and a tool holder adapted to be moved laterally in said channel and be selectively positioned therein, the improvement wherein said tool holder is characterized by separate first and second bracket members adapted to be connected together, said bracket members including a mounting plate connectable to said channel and an interconnectable connecting plate, gripping means for producing a releasable gripping force on a handle, said gripping means including a fixed gripping member and a gravity operated vertically movable gripping member connected, respectively, to one and the other of said mounting plates, and connecting means for connecting the first bracket member to the second bracket member, said connecting means comprising a plurality of posts and laterally spaced apertures disposed along linear rows extending horizontally and vertically on each of said connector plates, wherein said posts are arranged for selective placement and interlocking engagement with predetermined of the apertures, whereby the lateral separation between the bracket members can be increased or decreased.

16. The improvement as claimed in claim 15, including a pair of laterally spaced rows of apertures and a row of posts, wherein the apertures extend through one said connector plate and the posts project from the other said connector plate for interlocking engagement with a corresponding aperture in one said row of apertures.

17. The improvement as claimed in claim 15 including spacer means for spacing the bracket members from the channel.

18. The improvement as claimed in claim 15, including securing means for securing said tool holder to said channel, said securing means including a fastening member extending through each said connecting plate, said spacer and said channel.

19. A tool holder for holding the handle of a tool, comprising a horizontally extending support channel, gripper means defining laterally separated first and second gripper elements for receiving and gripping the tool handle inserted between the elements, means for securing said gripper elements in said channel, first adjustment means for increasing the lateral separation between said gripper elements whereby to increase the size of said tool handle which can be gripped by said gripper elements, and second adjustment means for increasing the lateral separation between said gripper element whereby to further increase the size of said tool handle which can be gripped by said gripper elements, said second adjustment means being operable independently of said first adjustment means and including a pair of integral posts and an array of apertures associated, respectively, with one and the other of said gripper elements, said apertures being disposed in a predetermined grid and sized to receive and interlock with selective of the posts.

20. The tool holder as claimed in claim 19 wherein said second adjustment means comprises a pair of separate mounting plates, said securing means including guide ribs extending from the mounting plates for engaging the channel and a connecting plate, and interlocking means for interlocking the connector plates in more than one laterally separated position, said interlocking means including said posts being disposed in one of said mounting plates and the apertures being formed in the other of said mounting plates.

21. The tool holder as claimed in claim 20 wherein said gripper elements comprise a fixed wall and a roller provided with elastomeric material, and said first adjustment means comprises said fixed wall projecting from one of said mounting plates, and said roller projecting from the other of said mounting plates, said roller being mounted for vertical inclined movement whereby vertical movement of the roller increases the lateral separation of the roller from the fixed wall.

* * * * *